US009328464B2

(12) United States Patent
Urmson, Jr. et al.

(10) Patent No.: US 9,328,464 B2
(45) Date of Patent: May 3, 2016

(54) SINGLE BEND RAIL

(71) Applicant: Koppers Delaware, Inc., Wilmington, DE (US)

(72) Inventors: William Thomas Urmson, Jr., Valencia, PA (US); John W. Mospan, Pittsburgh, PA (US)

(73) Assignee: Koppers Delaware, Inc., Wilmington, DE (US)

( * ) Notice: Subject to any disclaimer, the term of this patent is extended or adjusted under 35 U.S.C. 154(b) by 280 days.

(21) Appl. No.: 14/025,370

(22) Filed: Sep. 12, 2013

(65) Prior Publication Data

US 2014/0076980 A1 Mar. 20, 2014

Related U.S. Application Data

(60) Provisional application No. 61/701,185, filed on Sep. 14, 2012.

(51) Int. Cl.

| | |
|---|---|
| ***E01B 5/00*** | (2006.01) |
| ***E01B 5/02*** | (2006.01) |
| ***E01B 11/02*** | (2006.01) |
| ***E01B 11/54*** | (2006.01) |

(52) U.S. Cl.
CPC . *E01B 5/02* (2013.01); *E01B 11/02* (2013.01); *E01B 11/54* (2013.01)

(58) Field of Classification Search
CPC ..... E01B 5/02; E01B 11/02; E01B 11/54; E01B 11/42; E01B 11/28; E01B 11/32; E01B 11/00; E01B 11/01; E01B 7/00; E01B 7/01
See application file for complete search history.

(56) References Cited

U.S. PATENT DOCUMENTS

| | | | | |
|---|---|---|---|---|
| 919,280 A | | 4/1909 | Akers | |
| 1,237,982 A | | 8/1917 | Wellendorf | |
| 2,130,106 A | | 9/1938 | Schermerhorn | |
| 2,209,725 A | * | 7/1940 | Bourland | 238/167 |
| 2,305,843 A | | 12/1942 | Chagnon | |
| 2,472,446 A | * | 6/1949 | Standfast | 238/230 |
| 2,822,137 A | | 2/1958 | Groseclose | |
| 3,006,553 A | * | 10/1961 | Greer | 238/152 |
| 3,499,604 A | * | 3/1970 | Nelson | 238/230 |

(Continued)

FOREIGN PATENT DOCUMENTS

DE 3108339 A1 9/1982

OTHER PUBLICATIONS

Akhtar et al., "Development of an Improved Performance Bonded Insulated Joint for HAL Service", Technology Digest, May 2006, TD-06-012, Transportation Technology Center, Inc., Pueblo Colorado.

(Continued)

*Primary Examiner* — Jason C Smith
(74) *Attorney, Agent, or Firm* — The Webb Law Firm

(57) ABSTRACT

A railroad rail includes a body defining a first section and a tapered second section with the body defining a head section, a web section depending from the head section, and a base section depending from the web section. The head section, the web section, and the base section define an end surface configured to mate with a corresponding end surface of a complementary railroad rail when joined together. The railroad rail is formed from a single bent railroad rail having only a single bend defined by the head section, web section, and base section of the body of the railroad rail.

22 Claims, 7 Drawing Sheets

(56) References Cited

U.S. PATENT DOCUMENTS

| | | | | | |
|---|---|---|---|---|---|
| 3,727,838 | A | | 4/1973 | Bergh | |
| 3,851,821 | A | * | 12/1974 | Lopez | 238/230 |
| 3,952,948 | A | * | 4/1976 | Nelson et al. | 238/243 |
| 4,171,774 | A | | 10/1979 | Deslauriers | |
| 4,209,130 | A | * | 6/1980 | Sundsrud et al. | 238/152 |
| 4,485,967 | A | * | 12/1984 | Edwards | 238/226 |
| 4,637,578 | A | * | 1/1987 | Frank | 246/391 |
| 5,503,331 | A | * | 4/1996 | Uramson et al. | 238/152 |
| 5,533,670 | A | | 7/1996 | Chen | |
| 5,842,637 | A | * | 12/1998 | Lanzer | 238/152 |
| 6,581,351 | B2 | | 6/2003 | DeVivi | |
| 6,672,516 | B1 | * | 1/2004 | Skoutelas | 238/174 |
| 7,975,933 | B2 | | 7/2011 | Urmson, Jr. et al. | |
| 8,113,441 | B2 | | 2/2012 | Urmson, Jr. et al. | |
| 8,302,878 | B2 | | 11/2012 | Urmson, Jr. et al. | |
| 8,561,916 | B1 | * | 10/2013 | Remington et al. | 238/151 |
| 2005/0098646 | A1 | * | 5/2005 | Urmson et al. | 238/151 |
| 2006/0027674 | A1 | * | 2/2006 | Urmson et al. | 238/243 |
| 2006/0243818 | A1 | * | 11/2006 | Urmson et al. | 238/152 |
| 2008/0083836 | A1 | * | 4/2008 | Urmson et al. | 238/151 |
| 2008/0315045 | A1 | * | 12/2008 | Bogl | 246/415 R |
| 2009/0013898 | A1 | * | 1/2009 | Zheng et al. | 104/130.01 |
| 2010/0270386 | A1 | * | 10/2010 | Mospan et al. | 238/152 |
| 2011/0233292 | A1 | * | 9/2011 | Langenbeck | 238/35 |
| 2012/0111958 | A1 | | 5/2012 | Urmson, Jr. et al. | |
| 2014/0076980 | A1 | * | 3/2014 | Urmson et al. | 238/125 |

OTHER PUBLICATIONS

Davis et al., "Analysis of Conventional and Tapered Bonded Insulated Rail Joints", Technology Digest, May 2006, TD-06-014, Transportation Technology Center, Inc. , Pueblo Colorado.

Akhtar et al., "Preliminary Results of Prototype Insulated Joint Tests at FAST", Technology Digest, May 2007, TD-07-013, Transportation Technology Center, Inc., Pueblo Colorado.

Davis et al., "Evaluation of Improved Designs for Bonded Insulated Joints in HAL Service", Technology Digest, Jul. 2007, TD-07-020, Transportation Technology Center, Inc., Pueblo Colorado.

Davis et al., "Prototype Next Generation Insulated Joints", Technology Digest, Mar. 2010, TD-10-009, Transportation Technology Center, Inc., Pueblo Colorado.

* cited by examiner

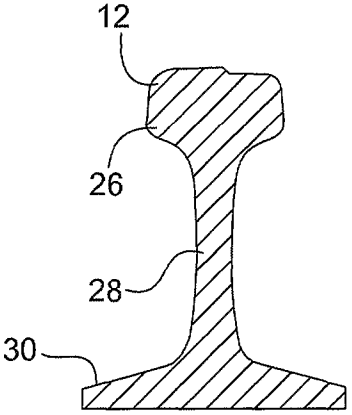
FIG. 7A
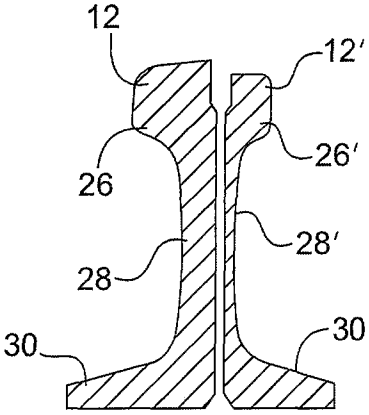
FIG. 7B
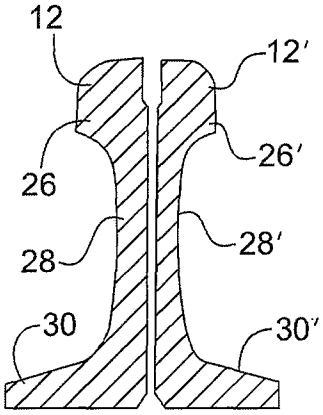
FIG. 7C
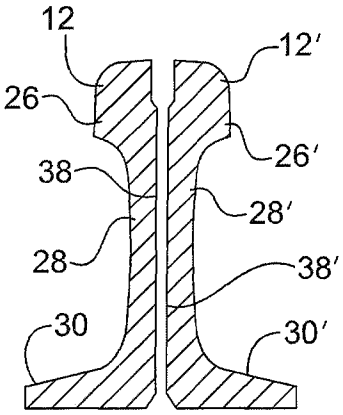
FIG. 7D
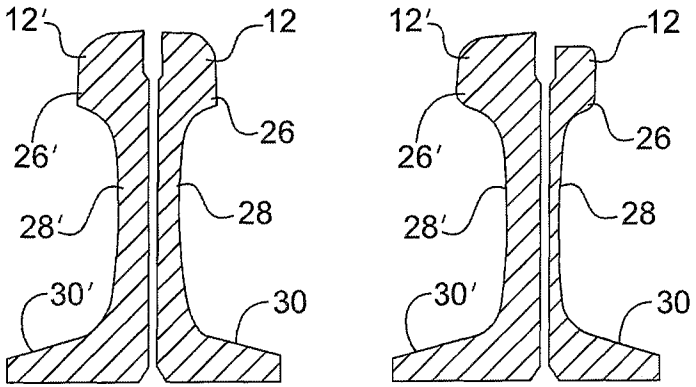
FIG. 7E
FIG. 7F
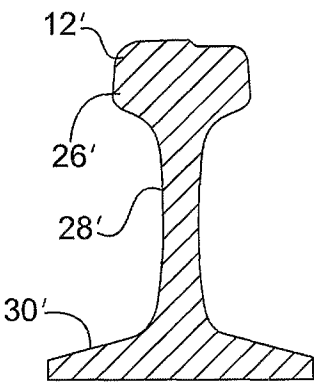
FIG. 7G

SINGLE BEND RAIL

The present application claims the benefit of U.S. Provisional Application Ser. No. 61/701,185, filed Sep. 14, 2012, the entire disclosure of which is hereby incorporated by reference.

BACKGROUND OF THE INVENTION

1. Field of the Invention

The present invention relates to the method and apparatus for electrically isolating two adjoining railroad rail sections together and, more particularly, to providing joined insulated rails that are machined.

2. Description of Related Art

Rail systems are often divided into sections or blocks to permit more than one train to travel on one stretch of rail. The purpose of dividing railroad rails of a rail system into sections is to detect the presence of a train on a section of rail at any given time. Each rail section is electrically isolated from all other sections so that a high electrical resistance can be measured over the rail section when no train is present in that section. When a train enters a rail section, the train will short circuit adjacent railroad rails in which the electrical resistance in the rail section drops, thereby indicating the presence of a train.

Railroad rails are generally welded to each other or attached to each other by a steel joint. Typical railroad rails generally include a body having a head section, a web section, and a base section, with the web section defining an opening for receiving fasteners. In order to electrically isolate adjacent rail sections of a rail system, high-performance, non-metallic joints or steel joints having electrically-insulated material bonded to its surface, are typically used in conjunction with electrically-insulating material placed between abutting ends of joined railroad rails. Through extended use, the wheels of the train will often cause the ends of conventional rails to deform and/or break apart (referred to in the industry as end batter), causing the railroad rails to contact each other and short out.

Certain prior art rail joint arrangements address this problem by providing two joined railroad rails that have been machine cut, tapered, and trimmed to complement each other and form a Z-shaped cut. This arrangement spreads the impact load of the train wheels over a longer area, thus increasing the Moment of Inertia at a section where the railroad rails are joined. Although the arrangement has a high Moment of Inertia, which can be defined as the capacity of a cross-section to resist bending, this arrangement utilizes non-standard railroad rails having a double-thick web section, such that non-standard rail joint bars have to be used when attaching the railroad rails to each other.

SUMMARY OF THE INVENTION

In one embodiment, a railroad rail includes a body defining a first section and a tapered second section with the body defining a head section, a web section depending from the head section, and a base section depending from the web section. The head section, the web section, and the base section define an end surface configured to mate with a corresponding end surface of a complementary railroad rail when joined together. The railroad rail is formed from a single bent railroad rail having only a single bend defined by the head section, web section, and base section of the body of the railroad rail.

The web section of the body at the tapered second section may have a thickness that is about constant. The web section of the body at the tapered second section may have a thickness that varies less than 5%. The body may define a first recessed portion that extends downward from a top surface of the head section of the body toward the base section with the first recessed portion ending at an end of the tapered second section that is remote from the first section. The body may define a second recessed portion that extends downward from the top surface of the head section of the body toward the base section with the second recessed portion positioned at the first section of the body. The second recessed portion may end at a position adjacent to the tapered second section.

In another embodiment, a rail joint assembly includes first and second rails each having a body defining a first section and a tapered second section. The body of each of the first and second rails defines a head section, a web section depending from the head section, and a base section depending from the web section. The head section, the web section, and the base section of each rail defines an end surface with the end surface of the first rail configured to mate with the end surface of the second rail when joined together. The first and second rails are formed from a single bent railroad rail having only a single bend defined by the head section, web section, and base section of the single bent railroad rail. The rail joint assembly also includes at least two joint bars configured to be secured to the first and second rails by a plurality of fasteners.

The at least two joint bars may comprise only two bonded joint bars. The end surfaces of the first and second rails may overlap in a transverse direction when joined together. The end surfaces of the first and second rails may overlap for a length of about 15 inches. The at least two joint bars may also comprise two bonded joint bars and two standard joint bars. The end surfaces of the first and second rails may overlap in a transverse direction when joined together. The end surfaces of the first and second rails may overlap for a length of about 30 inches. The web section of the body of each of the first and second rails may have a thickness that is about constant at the tapered second section. The body of each of the first and second rails may define a first recessed portion that extends downward from a top surface of the head section of the body toward the base section with the first recessed portion ending at an end of the tapered second section that is remote from the first section. The body of each of the first and second rails may define a second recessed portion that extends downward from the top surface of the head section of the body toward the base section where the second recessed portion is positioned at the first section of the body. The second recessed portion may end at a position adjacent to the tapered second section.

In a further embodiment, a method for manufacturing a railroad rail end section for use in an insulating rail joint assembly includes providing a railroad rail having a body and defining a head section, a web section depending from the head section, and a base section depending from the web section. The method also includes bending the head section, web section, and base section of the railroad rail, where the head section, web section, and base section of the railroad rail is only bent at a single point. The method further includes machining the railroad rail thereby forming a first section and a tapered second section, where a predetermined portion of the base section, the web section, and the head section of the second section is removed to define an end surface that is configured to mate with a corresponding end surface of a complementary railroad rail when joined together.

The method may also include trimming the machined railroad rail, where a portion of a top surface of the head section of the first section tapers downward toward the base section and, where a portion of a top surface of the head section of the second section tapers downward toward the base section ending at the second end of the second section.

BRIEF DESCRIPTION OF THE DRAWINGS

FIGS. 7A-7G show cross-sectional views of mating rail end sections taken along section lines 7A, 7B, 7C, 7D, 7E, 7F, and 7G, respectively, of FIG. 6.

DETAILED DESCRIPTION OF THE INVENTION

Figure 1:
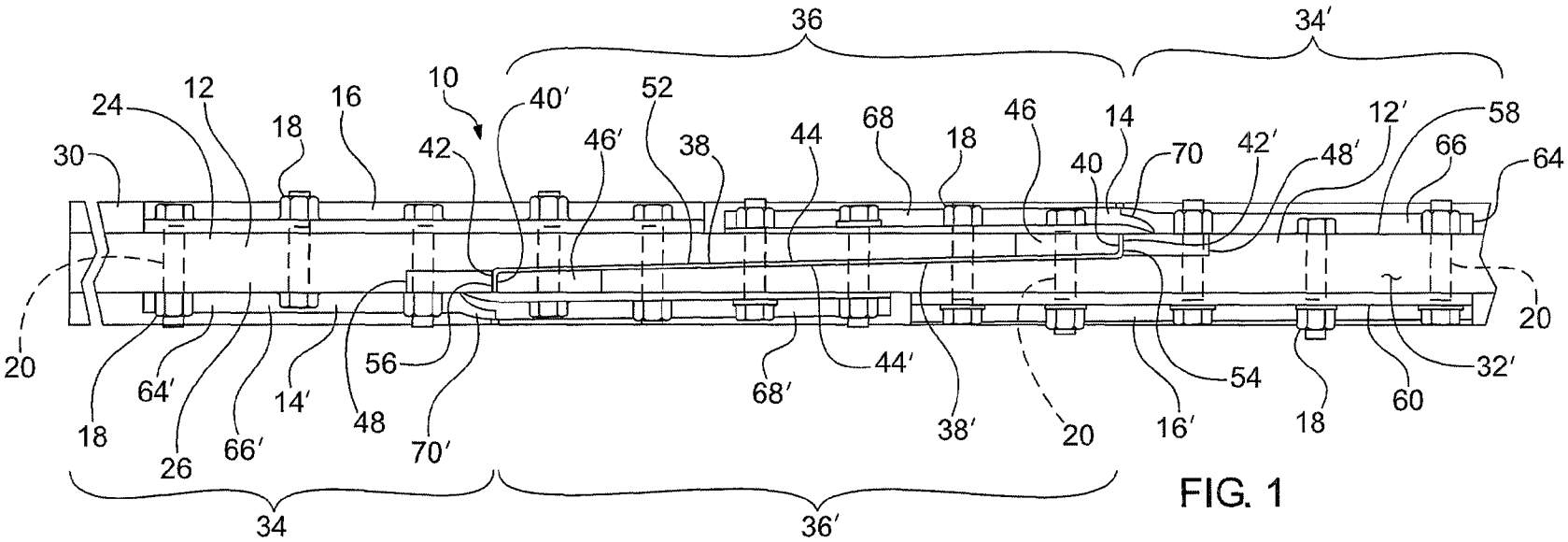
FIG. 1 is a top plan view of a railroad rail joint assembly according to one embodiment of the present invention.

For purposes of the description hereinafter, the words "upward" and "downward", and like spatial terms, if used, shall relate to the described embodiments as oriented in the drawing figures. However, it is to be understood that many alternative variations and embodiments may be assumed except where expressly specified to the contrary. The specific devices and embodiments illustrated in the accompanying drawings and described herein are simply exemplary embodiments of the invention.

Figure 2:
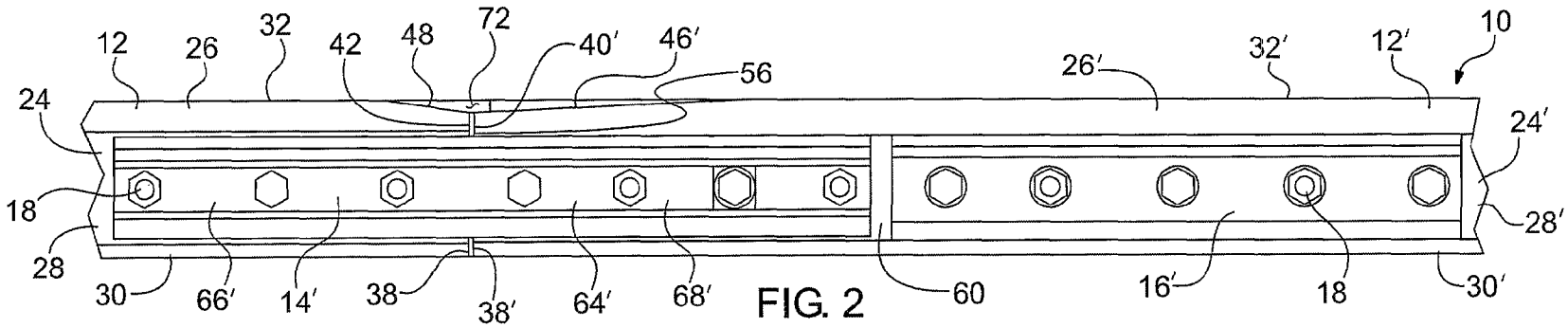
FIG. 2 is a side elevational view of the joint assembly shown in FIG. 1.

Referring to FIGS. 1 and 2, one embodiment of a rail joint assembly 10 includes first and second railroad rails 12, 12', first and second bonded joint bars 14, 14', first and second standard joint bars 16, 16', a plurality of fasteners 18, and a plurality of insulating bushings 20.

Figure 3:
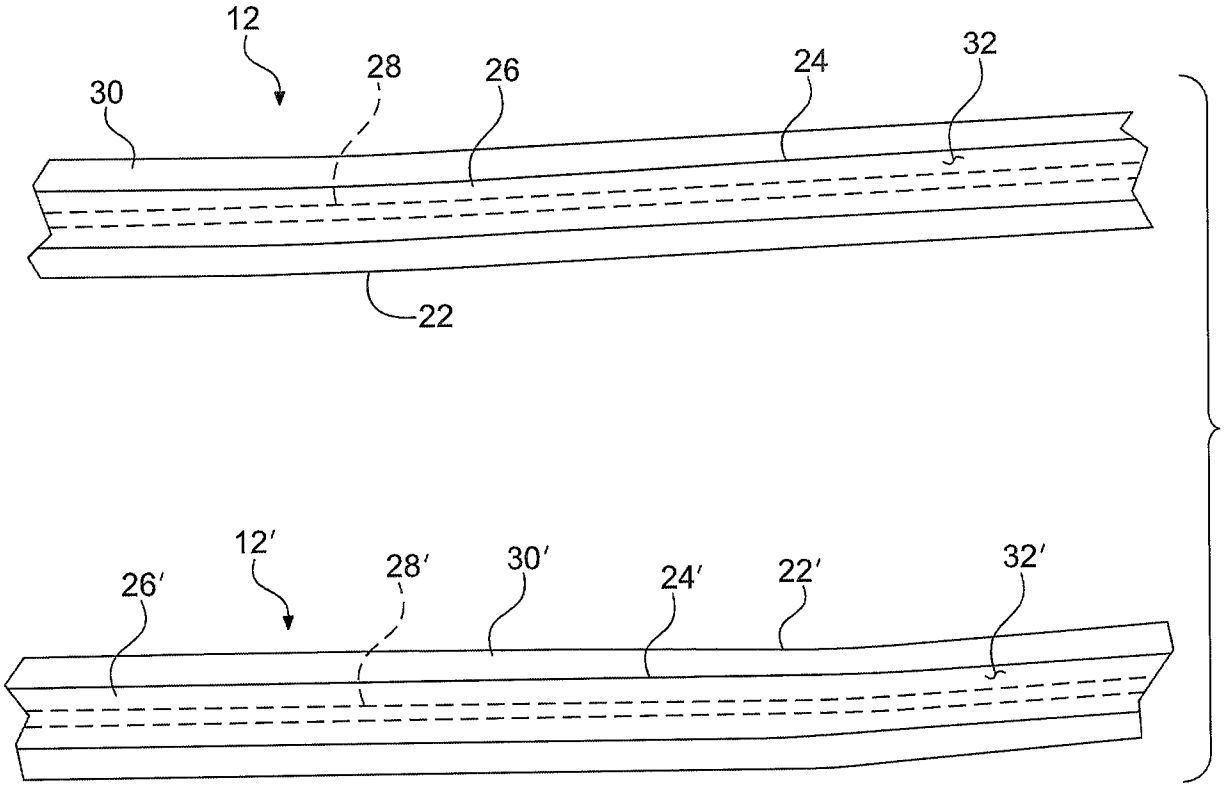
FIG. 3 is a top plan view of mating railroad rails of the joint assembly of FIG. 1 after bending and prior to machining.
Figure 4:
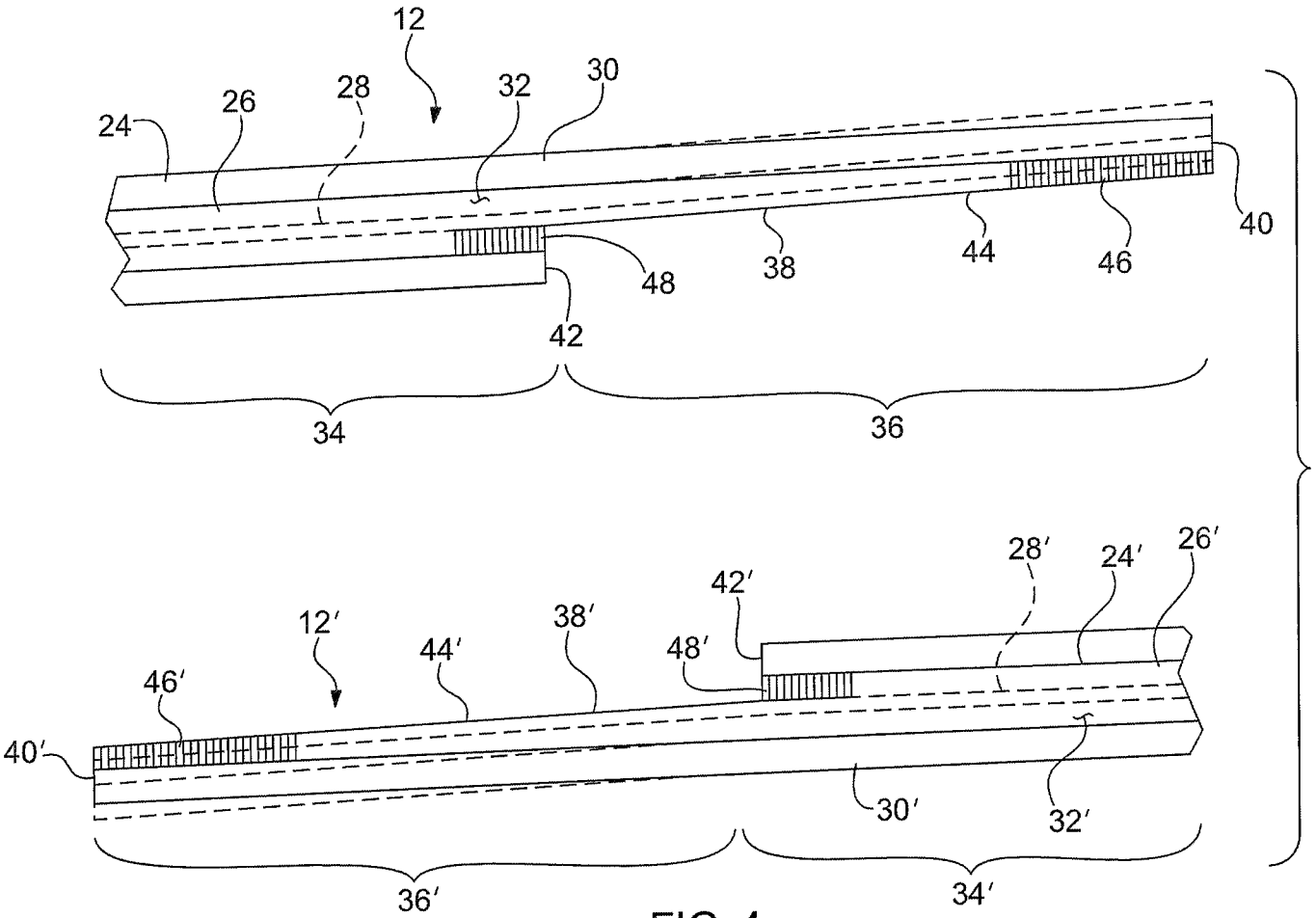
FIG. 4 is a top plan view of mating railroad rails of the joint assembly of FIG. 1 after machining.
Figure 5:
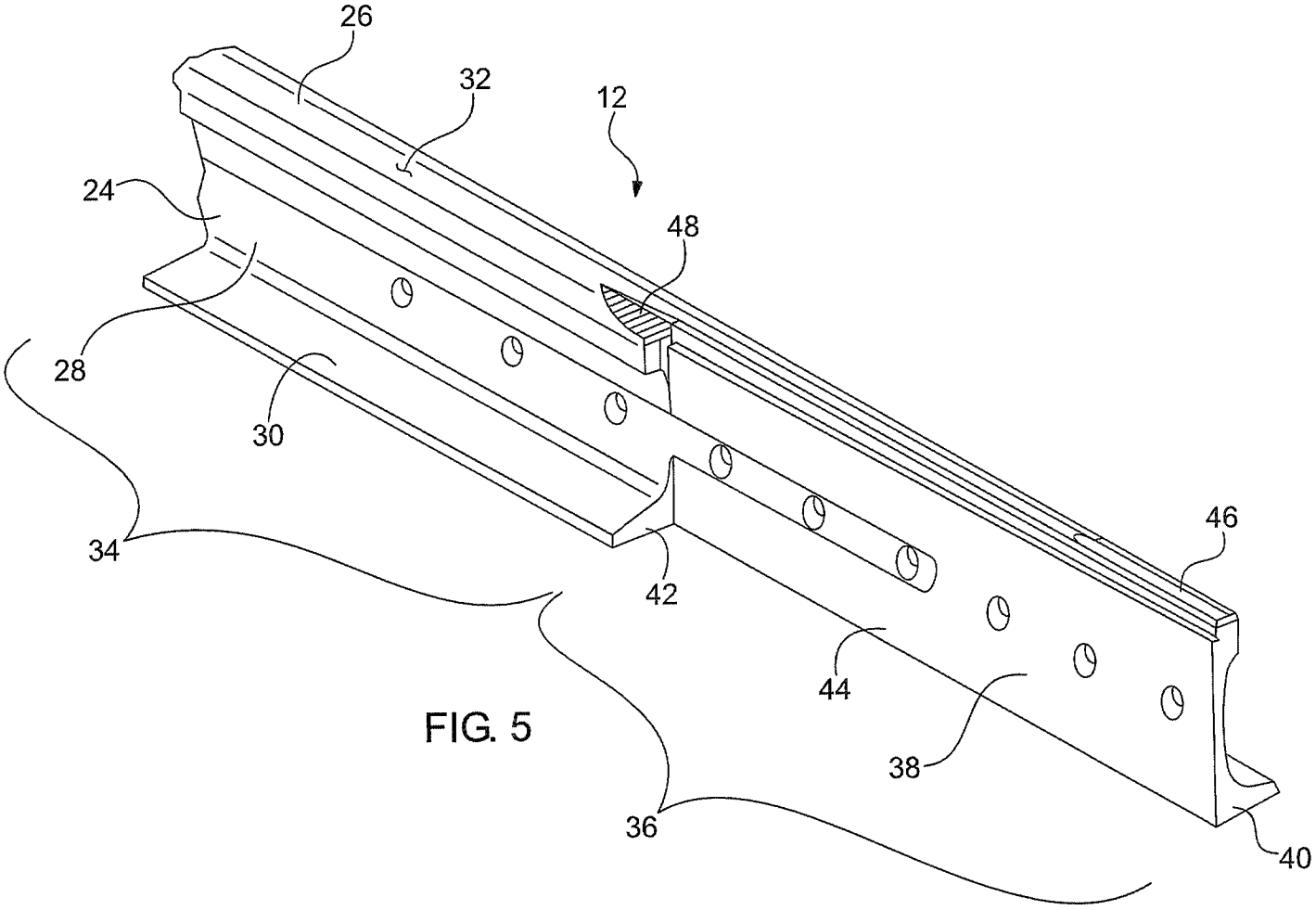
FIG. 5 is a perspective view of a rail of the joint assembly of FIG. 1.

Referring to FIG. 3, the first and second rails 12, 12' are formed by initially bending the rails at a single point 22, 22'. In one embodiment, the angle of the bend is about 1.2 degrees, although other suitable angles of the bend may also be utilized. The rails 12, 12' can be any size or type of standard tee railroad rail, such as 132-RE, 136-RE, and 141-RE rails according to the American Railway Engineering and Maintenance-of-Way Association (AREMA) specifications.

Figure 6:
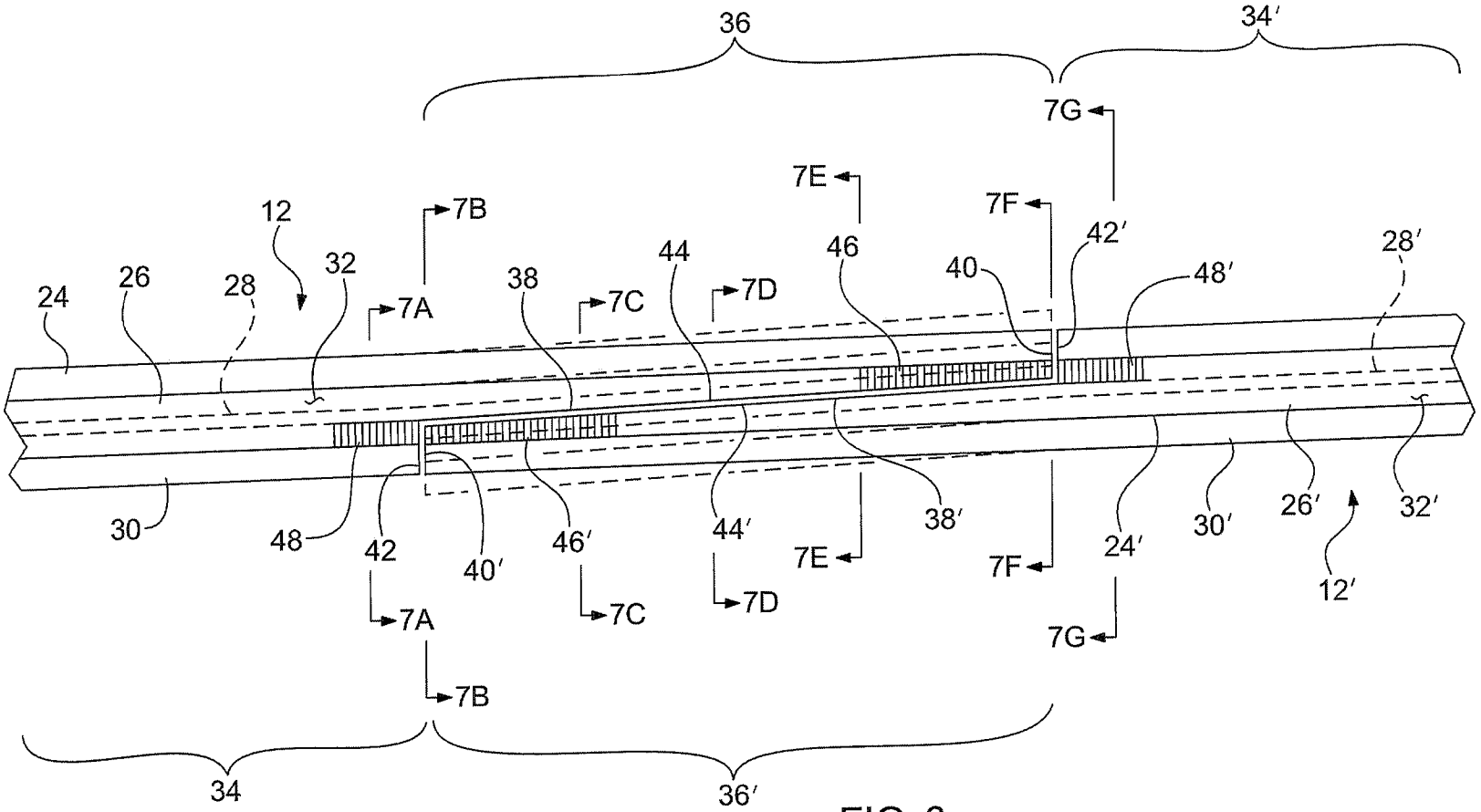
FIG. 6 is top plan view of mating railroad rails of the joint assembly of FIG. 1 showing the rails joined together.

Referring to FIGS. 3-6, the first and second rails 12, 12' each include a body 24, 24' having a head section 26, 26', a web section 28, 28' connected to the head section 26, 26', and a base section 30, 30' connected to the web section 28, 28'. The web sections 28, 28' are shown in dashed lines in FIG. 3. Each of the head sections 26, 26' of the first and second rails 12, 12' has a top surface 32, 32'. The bending of the rails 12, 12' is the first step prior to machining the first and second rails 12, 12' to complement each other when joined, as shown in FIG. 6. Each of the rails 12, 12' is bent a single time to define a single bend. As shown in FIG. 6, the first rail 12 is bent upward in a first direction away from the second rail 12' and the second rail 12' is bent downward in a second direction away from the first rail 12.

Referring again to FIG. 4, after bending, the first and second rails 12, 12' are machine trimmed and tapered. The portion of the first and second rails 12, 12' that has been removed through the machining process is shown in dashed lines. In particular, predetermined portions of the head sections 26, 26', the web sections 28, 28', and the base sections 30, 30' of the first and second rails 12, 12' are removed. After machining, each of the rails 12, 12' includes a first section 34, 34' and a second tapered section 36, 36'. The first and second rails 12, 12' each define a generally Z-shaped end surface 38, 38'. The end surfaces 38, 38' each include first and second transverse portions 40, 40', 42, 42', with an angled portion 44, 44' extending between the first and second transverse portions 40, 40', 42, 42'. The first transverse portion 40, 40' and the angled portion 44, 44' are defined by the second tapered section 36, 36' of each rail 12, 12'. The second transverse portion 42, 42' generally extends between the first and second sections 34, 34', 36, 36' of each rail 12, 12'. The first and second rails 12, 12' each include first and second recessed portions 46, 46', 48, 48'. In particular, the second tapered section 36, 36' of each rail 12, 12' includes the first recessed portion 46, 46' that extends downward from the top surface 32, 32' of the head section 26, 26' toward the base section 30, 30' of each rail 12, 12'. The first section 34, 34' of each rail 12, 12' includes the second recessed portion 48, 48' that also extends downward from the top surface 32, 32' of the head section 26, 26' toward the base section 30, 30' of each rail 12, 12'. In certain embodiments, the first and second rails 12, 12' may not include the first and second recessed portions 46, 46', 48, 48'.

The first and second rails 12, 12' are mirror images of each other such that the rails 12, 12', after machining and trimming, complement each other when joined as shown in FIG. 6. The web section 28, 28' of the first and second rails 12, 12' at the respective second tapered sections 36, 36' has a thickness that is about constant. For example, in one embodiment, the thickness of the web section 28, 28' of the first and second rails 12, 12' at the respective second tapered sections 36, 36' may have a thickness that varies less than 5% and, more particularly, only 3.5%. In one embodiment, the thickness of the web section 28, 28' of the first and second rails 12, 12' at the second transverse portion 42, 42' is 0.6875" and narrows to a thickness of 0.6637" at the first transverse portion 40, 40', although the thickness of the web section 28, 28' may also remain a constant 0.6865" for the length of the second tapered section 36, 36'.

Referring again to FIG. 1, the first and second rails 12, 12' are shown positioned adjacent to each other with a center rail insulator 52 positioned between the angled portions 44, 44' of the end surfaces 38, 38'. The center rail insulator 52 is generally rectangular shaped and is made from electrically-insulating material, such as polyurethane, although other suitable materials may be utilized for the center rail insulator 52. A first end post 54 is positioned between the first transverse portion 40 of the first rail 12 and the second transverse portion 42' of the second rail 12'. A second end post 56 is positioned between the second transverse portion 42 of the first rail 12 and the first transverse portion 40' of the second rail 12'. The first and second end posts 54, 56 are generally C-shaped and correspond to about one-half of the transverse cross section of the first and second rails 12, 12'.

Referring to FIGS. 7A-7G, various cross-sectional views of the first and second rails 12, 12' are shown when joined to each other. The profiles of the first and second rails 12, 12' change over the length of the joined rails. The cross section shown in FIG. 7D generally shows the midpoint of the joined end surfaces 38, 38' of the first and second rails 12, 12'. As shown in FIGS. 7A-7C, the first rail 12 is a more dominant part of the joined rails 12, 12' at those respective sections of the rail joint assembly 10. As shown in FIGS. 7E-7G, the second rail 12' is a more dominant part of the joined rails 12, 12' at those respective sections of the rail joint assembly 10. Further, as shown in FIGS. 7B-7F, the first and second rails 12, 12' are chamfered at the bottom of the base sections 30, 30' and at the end surfaces 38, 38', which reduces the possibility of shorting of the rails 12, 12' caused by dust, metal particles, etc. accumulating between the rails 12, 12'. Although a chamfer is shown, other suitable shaped recesses may also be utilized to reduce the chance of shorting.

Referring again to FIGS. 1 and 2, the end surfaces 38, 38' of the first and second rails 12, 12' are positioned adjacent to each other, with the center rail insulator 52 and end posts 54, 56 positioned between the rails 12, 12', as discussed above. Accordingly, the first and second rails 12, 12' are overlapped with each other where the end surfaces 38, 38' meet. In particular, the angled portions 44, 44' of the end surfaces 38, 38' of the first and second rails 12, 12' are overlapped in a transverse direction of the rails 12, 12'. The overlap between the first and second rails 12, 12' is 30 inches, although other suitable lengths of overlap may also be utilized. The first bonded joint bar 14 is positioned on a first side 58 of the first and second rails 12, 12' and is secured to the first and second rails 12, 12', and the second bonded joint bar 14' is positioned on a second side 60 of the first and second rails 12, 12' and is secured to the first and second rails 12, 12'. The first bonded joint bar 14 spans the first transverse portion 40 of the end surface 38 and the second transverse portion 42' of the end surface 38'. The second bonded joint bar 14' spans the second transverse portion 42 of the end surface 38 and the first transverse portion 40' of the end surface 38'. The first bonded joint bar 14 and the second bonded joint bar 14' overlap with each other about 8 inches in a transverse direction, although other suitable length overlaps may be utilized. The first and second bonded joint bars 14, 14' are secured to the first and second rails 12, 12' via the plurality of fasteners 18, which extend through respective openings defined by the first and second rails 12, 12' and the first and second bonded joint bars 14, 14'. The insulated bushings 20, which prevent shorting of the rail by the fasteners 18, are received in the openings of the first and second rails 12, 12' and receive the respective fasteners 18. In one embodiment, the first and second bonded joint bars 14, 14' are made of metal and bonded to the rails 12, 12' using epoxy. The first and second bonded joint bars 14, 14' are electrically insulated from the first and second rails 12, 12' via an electrical insulator, such as a fiberglass sleeve, positioned between the bonded joint bars 14, 14' and the first and second rails 12, 12'.

The first standard joint bar 16 is positioned on the first side 58 of the first rail 12 adjacent to the first bonded joint bar 14. The second standard joint bar 16' is positioned on the second side 60 of the second rail 12' adjacent to the second bonded joint bar 14'. The first and second standard joint bars 16, 16' are secured to the first and second rails 12, 12' via the plurality of fasteners 18, which extend through the insulating bushings 20 and the respective openings of the first and second rails 12, 12' and the first and second standard joint bars 16, 16'. The first and second standard joint bars 16, 16' are non-insulating and do not utilize an insulated sleeve. The rail joint assembly 10 has increased strength properties compared to conventional rail joints. For example, the rail joint assembly 10 may have approximately 58% more bond strength (e.g., shear strength) using the first and second bonded rail joint bars 14, 14' because of the mating end surfaces 38, 38'. An adhesive can also be used to bond the center rail insulator 52 and the end posts 54, 56 to the corresponding end surfaces 38, 38' of the rails 12, 12' to increase the strength of the rail joint assembly 10. The first and second standard joint bars 16, 16' add stiffness to the rails 12, 12' by increasing the Moment of Inertia. As shown in FIGS. 1 and 2, twelve fasteners 18 are utilized in the rail joint assembly 10, although other suitable numbers of fasteners may also be utilized.

Referring still to FIGS. 1 and 2, the first and second bonded rail joint bars 14, 14' each have a longitudinally extending body 64, 64' and are generally shaped similar to conventional rail joint bars. The first and second bonded rail joint bars 14, 14' include a first portion 66, 66' that is offset in a transverse direction from a second portion 68, 68' with an intermediate portion 70, 70' provided between the first and second portions 66, 66', 68, 68' of the bonded rail joint bars 14, 14'. The surface of the second portion 68, 68' that is configured to contact the rails 12, 12' is on a different plane relative to the surface of the first portion 66, 66' that is configured to contact the rails 12, 12'. Thus, the first portion 66, 66' of the bonded rail joint bars 14, 14' is provided along a first plane, with the intermediate portion 70, 70' extending outward from the first portion 66, 66' and joining the second portion 68, 68', which extends along a second plane. In addition to being offset from the first portion 66, 66', the second portion 68, 68' includes a single bend such that the second portion 68, 68' is not parallel to the first portion 66, 66'. In particular, the second portion 68, 68' is offset outward from the first portion 66, 66', but is also bent inwardly. The first and second standard joint bars 16, 16' have a slight bend of about 1 degree at the end that is closest to the adjacent bonded joint bar 14, 14', but do not include the offset described above. The thickness of the joined web sections 28, 28' of the first and second rails 12, 12' is greater than the thickness of the web sections 28, 28' of the individual rails 12, 12' before machining. The increase in thickness occurs at a point where the end surfaces 38, 38' of the first and second rails 12, 12' meet. The offset and bent portion of the first and second bonded rail joint bars 14, 14' is configured to accommodate the increase in thickness at this point.

When the rail joint assembly 10 is in use, the train wheels travel on the top surfaces 32, 32' of the head sections 26, 26' of the first and second rails 12, 12'. As the train wheels travel from the first rail 12 to the second rail 12', the second recessed portion 48 of the first rail 12 and the first recessed portion 46 of the second rail 12', which are positioned adjacent to each other, form a recessed transition area 72 that causes the weight of the train to shift primarily onto the first rail 12 where the web section 28 is thicker. Because the train wheels do not contact the recessed portions 46, 46', 48, 48' of the first and second rails 12, 12', the impact load of the train wheels shift to a portion where the web section 28, 28' is at its thickest. As the train wheels pass the first recessed portion 46 of the second rail 12', the load of the train wheels begins to shift to both rails 12, 12'. As the train wheels reach the first recessed portion 46 of the first rail 12, the load of the train wheels shifts primarily to the second rail 12' where the web section 28' is thicker. The rail joint assembly 10 results in a stronger and longer lasting assembly having a higher Moment of Inertia relative to conventional rail joint assemblies, thereby reducing the end batter and deformation caused by the train wheels.

Figure 8:
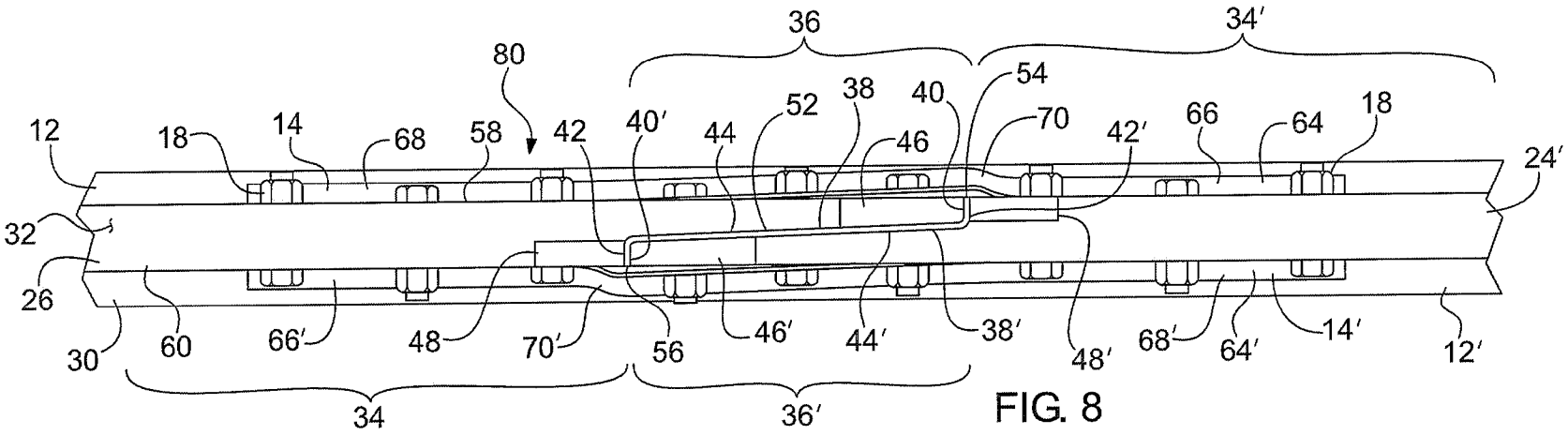
FIG. 8 is a top plan view of a railroad rail joint assembly according to a second embodiment of the present invention.
Figure 9:
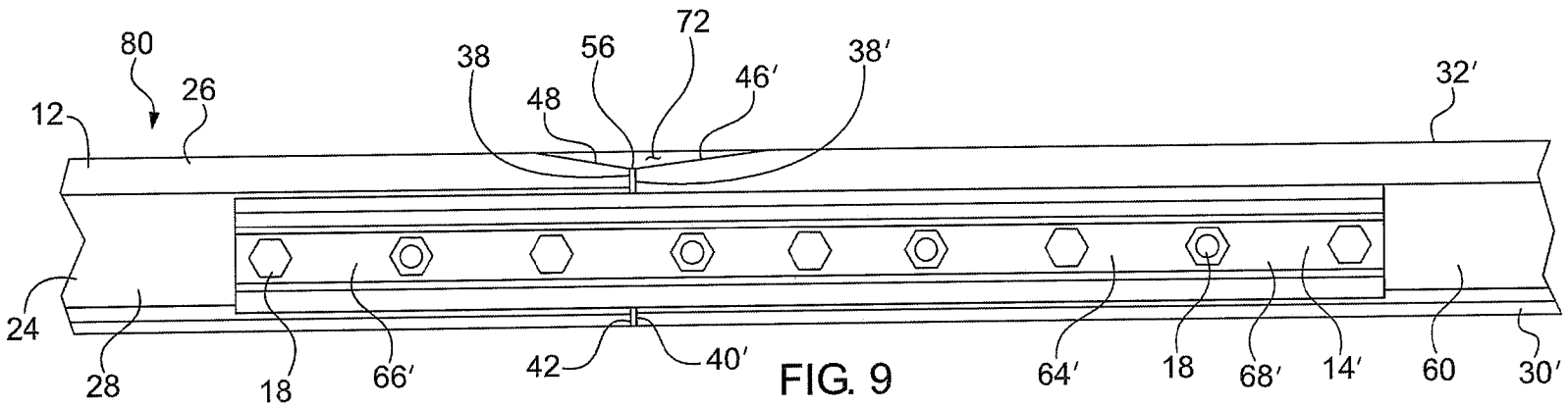
FIG. 9 is a side elevational view of the joint assembly shown in FIG. 8.

Referring to FIGS. 8 and 9, a second embodiment of a rail joint assembly 80 is shown. Like reference numbers are used for like elements. The rail joint assembly 80 shown in FIGS. 8 and 9 is similar to the rail joint assembly 10 shown in FIGS. 1-7 and described above. The rail joint assembly 80 of the present embodiment, however, has a shorter angle projection, resulting in a 15-inch overlap of the first and second rails 12, 12', rather than the 30-inch overlap of the rail joint assembly 10 shown in FIGS. 1-7. The angle of the single bend of the first and second rails 12, 12' is also 1.7 degrees rather than 1.2 degrees as in the rail joint assembly 10 shown in FIGS. 1-7, although other suitable angles of the bend may also be utilized. Other suitable length overlaps may also be utilized for the rail joint assembly 80. Further, the rail joint assembly 80 only utilizes two bonded joint bars 14, 14' that are the same as the bonded joint bars discussed above, except for their length. The bonded rail joint bars 14, 14' shown in FIGS. 8 and 9 also include two bends and the offset rather than the single bend as in the bonded rail joint bars 14, 14' shown in FIG. 1. In particular, the bonded rail joint bars 14, 14' of the present embodiment are longer than the first and second bonded rail joint bars 14, 14' of the rail joint assembly 10 shown in FIGS. 1-7. The rail joint assembly 80 also has increased strength properties compared to conventional rail joints. For example, the rail joint assembly 80 may have approximately 30% more bond strength (e.g., shear strength) using the first and second bonded rail joint bars 14, 14' because of the mating end surfaces 38, 38'. In certain embodiments, the first and second rails 12, 12' of the rail joint assembly 80 may not include the first and second recessed portions 46, 46', 48, 48'.

The rail joint assemblies 10, 80 discussed above and shown in FIGS. 1-9 provide first and second rails 12, 12' that have a single bend prior to trimming and machining. Only bending the rails 12, 12' a single time, rather than bending the rails 12, 12' twice, allows the rail joint assemblies 10, 80 to be made more economically without sacrificing significant strength. Further, maintaining quality and tolerances with a single bend is substantially easier than with double bent rails. Moreover, only bending the rails 12, 12' a single time allows the overlap of the joint to be shortened and enables the use of a two joint bar arrangement, as shown in FIGS. 8 and 9, instead of a four joint bar arrangement. Although a two joint bar arrangement will typically have less strength than a four joint bar arrangement, rail joint assemblies having a two joint bar arrangement are typically more economical.

While several embodiments of a rail joint assembly were described in the foregoing detailed description, those skilled in the art may make modifications and alterations to these embodiments without departing from the scope and spirit of the invention. Accordingly, the foregoing description is intended to be illustrative rather than restrictive.

The invention claimed is:

1. A railroad rail comprising:

a body formed from a standard tee railroad rail, the body defining a first section and a tapered second section, the body defining a head section, a web section depending from the head section, and a base section depending from the web section, the head section, the web section, and the base section defining an end surface configured to mate with a corresponding end surface of a complementary railroad rail when joined together, wherein the railroad rail is formed from a single bent railroad rail having only a single bend defined by the head section, web section, and base section of the body of the railroad rail, and wherein the web section of the body at the tapered second section has a thickness that is about constant.

2. The railroad rail of claim 1, wherein the web section of the body at the tapered second section has a thickness that varies less than 5%.

3. A railroad rail comprising:

a body defining a first section and a tapered second section, the body defining a head section, a web section depending from the head section, and a base section depending from the web section, the head section, the web section, and the base section defining an end surface configured to mate with a corresponding end surface of a complementary railroad rail when joined together, wherein the railroad rail is formed from a single bent railroad rail having only a single bend defined by the head section, web section, and base section of the body of the railroad rail, wherein the body defines a first recessed portion that extends downward from a top surface of the head section of the body toward the base section, the first recessed portion ends at an end of the tapered second section that is remote from the first section.

4. The railroad rail of claim 3, wherein the body defines a second recessed portion that extends downward from the top surface of the head section of the body toward the base section, the second recessed portion is positioned at the first section of the body.

5. A railroad rail comprising:

a body defining a first section and a tapered second section, the body defining a head section, a web section depending from the head section, and a base section depending from the web section, the head section, the web section, and the base section defining an end surface configured to mate with a corresponding end surface of a complementary railroad rail when joined together, wherein the railroad rail is formed from a single bent railroad rail having only a single bend defined by the head section, web section, and base section of the body of the railroad rail, and wherein the body defines a recessed portion that extends downward from a top surface of the head section of the body toward the base section, the recessed portion is positioned at the first section of the body.

6. The railroad rail of claim 5, wherein the recessed portion ends at a position adjacent to the tapered second section.

7. A rail joint assembly comprising:

first and second rails, each having a body defining a first section and a tapered second section, the body defining a head section, a web section depending from the head section, and a base section depending from the web section, the head section, the web section, and the base section of each rail defining an end surface, the end surface of the first rail configured to mate with the end surface of the second rail when joined together, wherein the first and second rails are formed from a single bent railroad rail having only a single bend defined by the head section, web section, and base section of the single bent railroad rail; and at least two joint bars configured to be secured to the first and second rails by a plurality of fasteners, wherein the web section of the body of each of the first and second rails has a thickness that is about constant at the tapered second section.

8. The rail joint assembly of claim 7, wherein the at least two joint bars comprise only two bonded joint bars.

9. The rail joint assembly of claim 8, wherein the end surfaces of the first and second rails overlap in a transverse direction when joined together.

10. The rail joint assembly of claim 9, wherein the end surfaces of the first and second rails overlap for a length of about 15 inches.

11. The rail joint assembly of claim 7, wherein the at least two joint bars comprise two bonded joint bars and two standard joint bars.

12. The rail joint assembly of claim 11, wherein the end surfaces of the first and second rails overlap in a transverse direction when joined together.

13. The rail joint assembly of claim 12, wherein the end surfaces of the first and second rails overlap for a length of about 30 inches.

14. The rail joint assembly of claim 7, wherein the first and second rails comprise a standard tee rail.

15. The rail joint assembly of claim 7, wherein the at least two joint bars comprise two bonded joint bars.

16. A rail joint assembly comprising:

first and second rails, each having a body defining a first section and a tapered second section, the body defining a head section, a web section depending from the head section, and a base section depending from the web section, the head section, the web section, and the base section of each rail defusing an end surface, the end surface of the first rail configured to mate with the end surface of the second rail when joined together, wherein the first and second rails are formed from a single bent railroad rail having only a single bend defined by the head section, web section, and base section of the single bent railroad rail; and at least two joint bars configured to be secured to the first and second rails by a plurality of fasteners, wherein the body of each of the first and second rails defines a first recessed portion that extends downward from a top surface of the head section of the body toward the base section, the first recessed portion ends at an end of the tapered second section that is remote from the first section.

17. The railroad rail of claim 16, wherein the body of each of the first and second rails defines a second recessed portion that extends downward from the top surface of the head section of the body toward the base section, the second recessed portion is positioned at the first section of the body.

18. A rail joint assembly comprising:

first and second rails, each having a body defining a first section and a tapered second section, the body defining a head section, a web section depending from the head section, and a base section depending from the web section, the head section, the web section, and the base section of each rail defining an end surface, the end surface of the first rail configured to mate with the end surface of the second rail when joined together, wherein the first and second rails are formed from a single bent railroad rail having only a single bend defined by the head section, web section, and base section of the single bent railroad rail; and at least two joint bars configured to be secured to the first and second rails by a plurality of fasteners, wherein the body of each of the first and second rails defines a recessed portion that extends downward from a top surface of the head section of the body toward the base section, the recessed portion is positioned at the first section of the body.

19. The railroad rail of claim 18, wherein the recessed portion ends at a position adjacent to the tapered second section.

20. A method for manufacturing a railroad rail end section for use in an insulating rail joint assembly, the method comprising:

providing a railroad rail having a body and defining a head section, a web section depending from the head section, and a base section depending from the web section;

bending the head section, web section, and base section of the railroad rail, wherein the head section, web section, and base section of the railroad rail is only bent at a single point; and machining the railroad rail thereby forming a first section and a tapered second section, wherein a predetermined portion of the base section, the web section and the head section of the second section is removed to define an end surface that is configured to mate with a corresponding end surface of a complementary railroad rail when joined together.

21. The method of claim 20, further comprising trimming the machined railroad rail, wherein a portion of a top surface of the head section of the first section tapers downward toward the base section and, wherein a portion of a top surface of the head section of the second section tapers downward toward the base section ending at the second end of the second section.

22. The method of claim 20, wherein the railroad rail comprises a standard tee railroad rail.

* * * * *

UNITED STATES PATENT AND TRADEMARK OFFICE

CERTIFICATE OF CORRECTION

PATENT NO. : 9,328,464 B2
APPLICATION NO. : 14/025370
DATED : May 3, 2016
INVENTOR(S) : W. Thomas Urmson, Jr. et al.

It is certified that error appears in the above-identified patent and that said Letters Patent is hereby corrected as shown below:

In the claims:

Column 9, Line 9, Claim 16, delete "defusing" and insert -- defining --

Column 9, Line 25, Claim 17, delete "The railroad rail of claim 16," and insert -- The rail joint assembly of claim 16, --

Column 10, Line 11, Claim 19, delete "The railroad rail of claim 18," and insert -- The rail joint assembly of claim 18, --

Signed and Sealed this
Second Day of August, 2016

Michelle K. Lee

Michelle K. Lee
*Director of the United States Patent and Trademark Office*